US006591827B2

(12) United States Patent
Fuchs

(10) Patent No.: US 6,591,827 B2
(45) Date of Patent: Jul. 15, 2003

(54) METHOD FOR PREPARING A DIAMOND

(76) Inventor: Roy Fuchs, 48 Levi Eshkol Street, Tel Aviv 69361 (IL)

( * ) Notice: Subject to any disclaimer, the term of this patent is extended or adjusted under 35 U.S.C. 154(b) by 13 days.

(21) Appl. No.: 09/891,095

(22) Filed: Jun. 25, 2001

(65) Prior Publication Data

US 2002/0195095 A1 Dec. 26, 2002

(51) Int. Cl.[7] ..... B28D 5/00
(52) U.S. Cl. ..... 125/30.01; 451/41; 63/32
(58) Field of Search ..... 451/28, 41, 43, 451/57, 54, 389; 63/32; 125/30.01, 39

(56) References Cited

U.S. PATENT DOCUMENTS 2,429,961 A * 10/1947 Rakowitzky
3,585,764 A * 6/1971 Huisman et al.
4,944,120 A * 7/1990 Weisman et al.
5,072,549 A * 12/1991 Johnston
5,462,474 A * 10/1995 Hansen ..... 451/41
6,397,832 B1 * 6/2002 Shuto ..... 125/30.01

* cited by examiner

*Primary Examiner*—Eileen P. Morgan
(74) *Attorney, Agent, or Firm*—Ladas & Parry

(57) ABSTRACT

A method for preparing a diamond having a six-pointed-star shaped girdle comprising: (1) providing a round diamond; and (2) grooving six equally spaced, equally-sized triangularly-shaped 120° angled grooves in the girdle of the round diamond. Also disclosed is a grooving machine comprising a dop, wherein the dop may be rotated between six equally-spaced stops.

9 Claims, 5 Drawing Sheets

METHOD FOR PREPARING A DIAMOND

FIELD OF THE INVENTION

This invention relates to a method for grooving diamonds.

BACKGROUND OF THE INVENTION

The value of a diamond is determined by several parameters. These include: shape, color, clarity, weight and polish. With respect to shape, the more accepted shape types are brilliant cut, radiant cut, princess cut, heart shape cut, pear shape cut, oval cut, marquise cut, emerald cut and trillion cut. Currently, the round brilliant cut is considered the most popular shape for a diamond.

The shape of the finished diamond is generally determined by the condition and shape of the rough crystal form which the diamond is cut. The decision on how to cut the rough crystal takes into account all of the above parameters, so as to obtain a diamond of maximum value. It is generally not accepted to cut a finished diamond, since the loss in weight reduces its value.

Diamonds are generally cut by a rapidly rotating disk impregnated with diamond dust. In the event that it is desired to cut a groove in the diamond, as in the heart-shaped cut, discs of successively wider cutting edge angles are used in order to cut the cleavage of the heart shape. Another cutting technique currently in use is cutting by a laser.

The 'Star of David' or 'Shield of David' is a symbol associated with the Jewish religion, as well as having a distinctive shape in its own right. It is a six-pointed star which may be formed by two superimposed triangles, one of which is rotated 180° with respect to the other. The Star of David is a popular shape in jewelry and brooches.

Diamonds are marketed which have a Star of David shape. These diamonds are cut from rough crystals whose natural, uncut shape is fortuitously similar to a Star of David. In order to lose the least amount of weight in the cutting process, such a crystal is cut in the shape of a Star of David. Since finding such a shaped crystal is rare, diamonds which have a Star of David shape are also rare. Such shaped diamonds are never cut from finished diamonds.

A piece of jewelry is known which is in the shape of a Star of David. In this product, a number of triangularly shaped diamonds are inlaid in the jewelry to form the Star of David shape.

SUMMARY OF THE INVENTION

It is an object of the invention to provide a method for preparing a diamond which exhibits the shape of a Star of David.

It is a further object of the invention to provide a diamond prepared by the method of the invention.

Thus, the present invention provides a method for preparing a diamond having a six-pointed-star shaped girdle comprising:

(i) providing a round diamond; and (ii) grooving six equally spaced, equally-sized triangularly-shaped 120° angled grooves in the girdle of said round diamond.

The present invention provides a repeatable method for preparing a diamond having a Star of David shape. The method does not depend on finding by chance a particularly shaped rough crystal.

The following terms appearing in the present specification have the following meanings:

Grooving—cutting a groove in the diamond, thereby extricating material from the diamond;

Grooving machine—a machine for grooving the diamond. The machine cuts with a grooving wheel (disc) having a tapered edge;

Round diamond—a finished diamond having a spherical shape;

Girdle—facets of a diamond on its widest edge;

Pavilion—lower portion of the diamond below the girdle;

Crown—the upper portion of the diamond above the girdle.

The present invention also provides a six-pointed-star shaped diamond shaped by the method of the invention.

Also included in the invention is a grooving machine in which the dop may be rotated between six equally-spaced stops, rather than the conventional eight. This allows the cutting of six equally-spaced grooves in the diamond in accordance with the method of the invention.

BRIEF DESCRIPTION OF THE DRAWINGS

In order to understand the invention and to see how it may be carried out in practice, a preferred embodiment will now be described, by way of non-limiting example only, with reference to the accompanying drawings, in which.

DETAILED DESCRIPTION OF THE INVENTION

Figure 1:
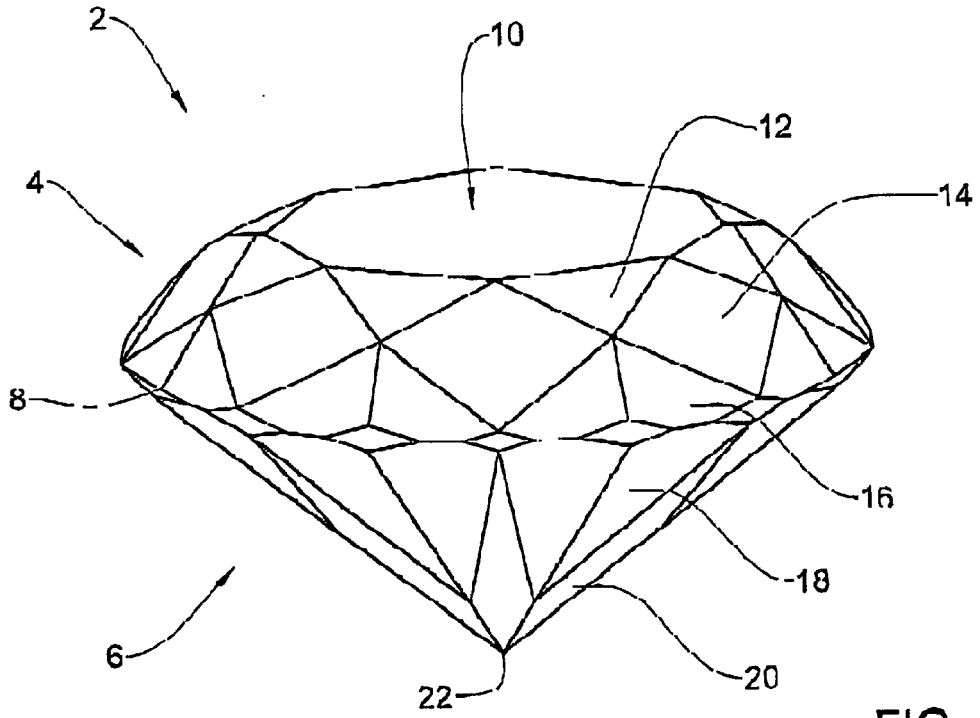
FIG. 1 is a perspective side view of a prior art round diamond.
Figure 2:
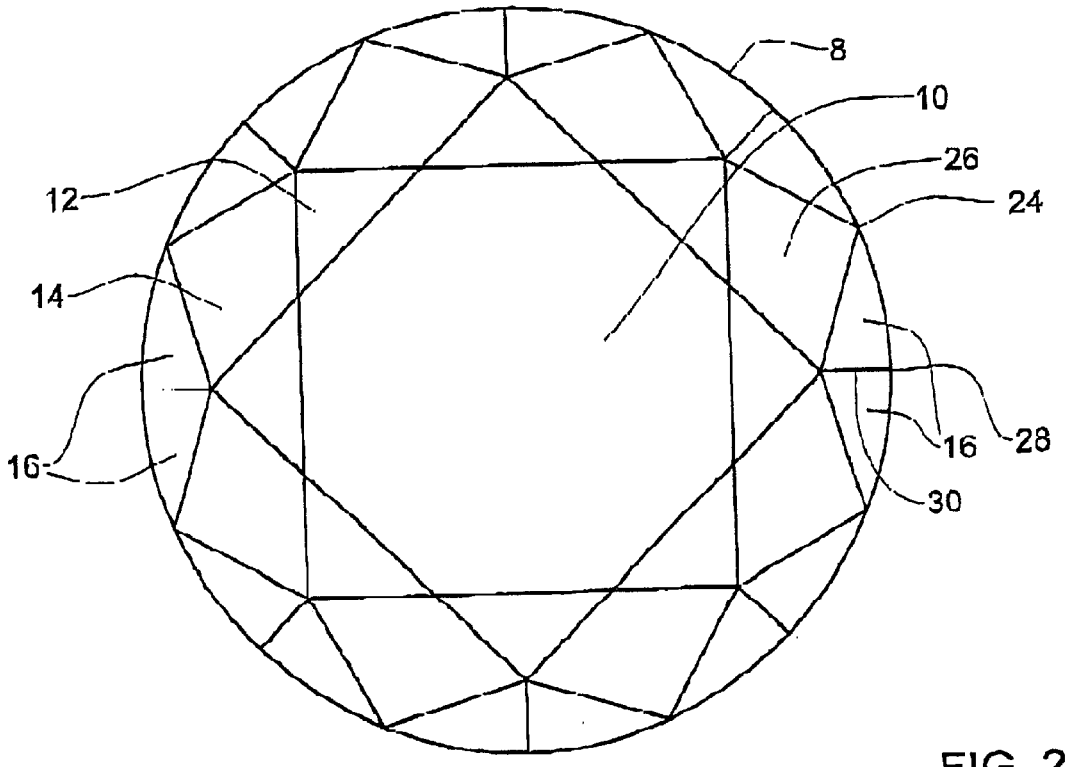
FIGS. 2, 3 & 4 are top views of the diamond of FIG. 1.

Referring now to FIG. 1, a brilliant-type round diamond, generally designated 2, is shown. The diamond comprises an upper portion 4 termed the crown, a lower portion 6 termed the pavilion, and a medial ring of facets 8 termed the girdle, intermediate between the crown and the pavilion. The facets of the crown 4 are termed a table facet 10 on its horizontal upper side, star facets 12 adjacent the table facet, bezel facets 14 intermediate between the star facets and upper girdle facets 16 contiguous with the upper edge of the girdle 8. The facets of the pavilion are termed lower girdle facets 18 contiguous with the lower edge of the girdle, and pavilion facets 20 extending from the girdle to the bottom point of the diamond, termed the culet 22.

Figure 3:
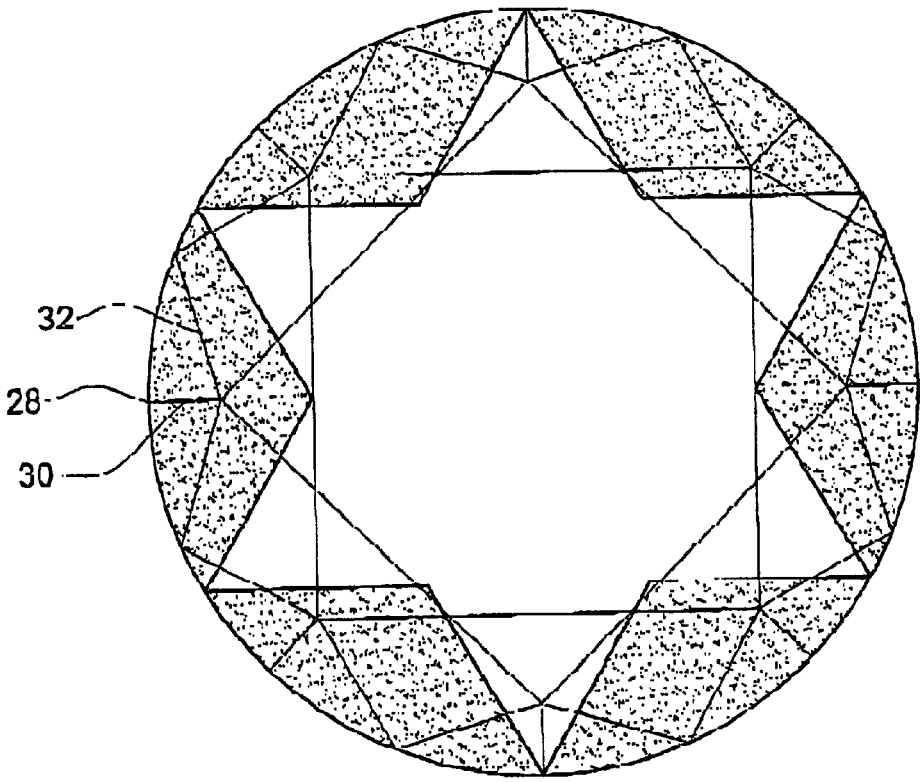
Figure 4:
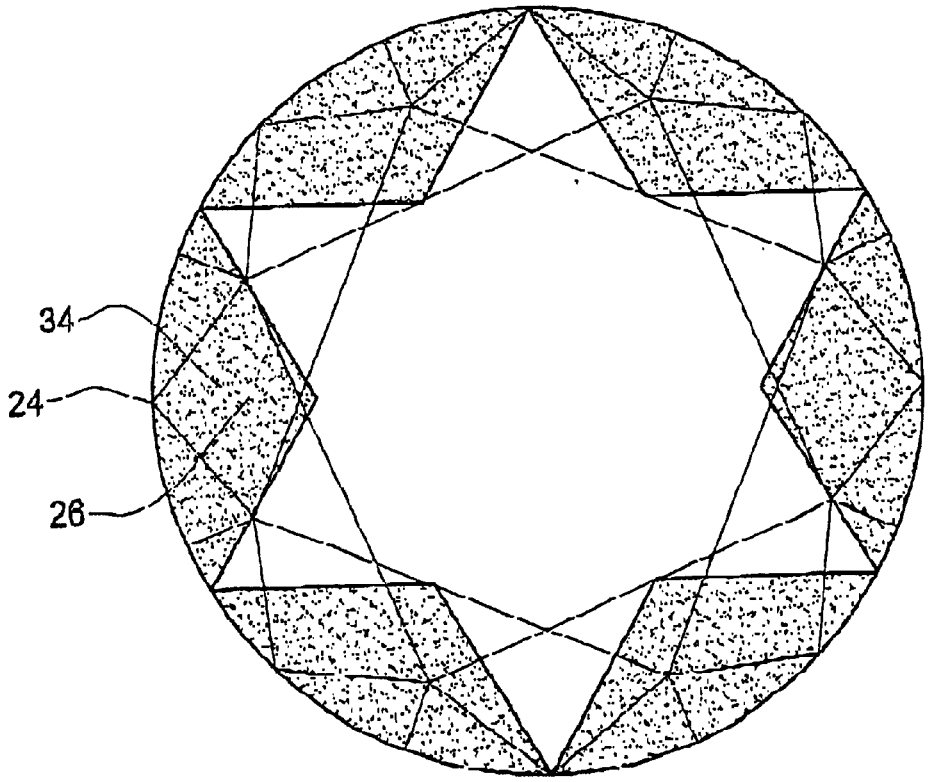
Figure 5:
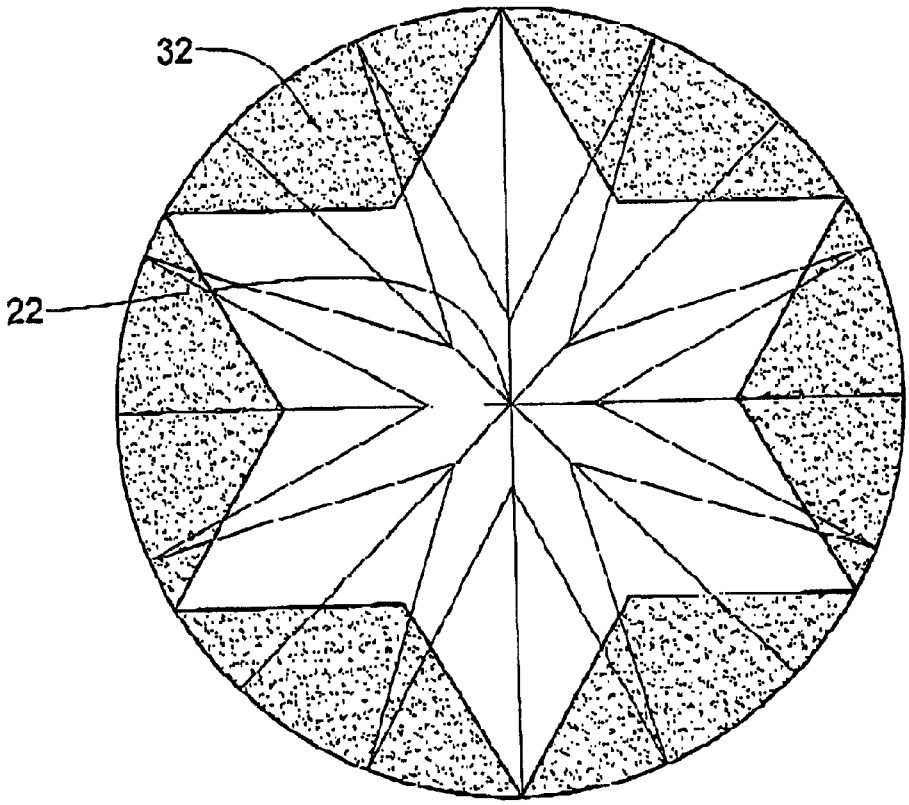
FIGS. 5 & 6 are bottom views of the diamond of FIG. 1.
Figure 6:
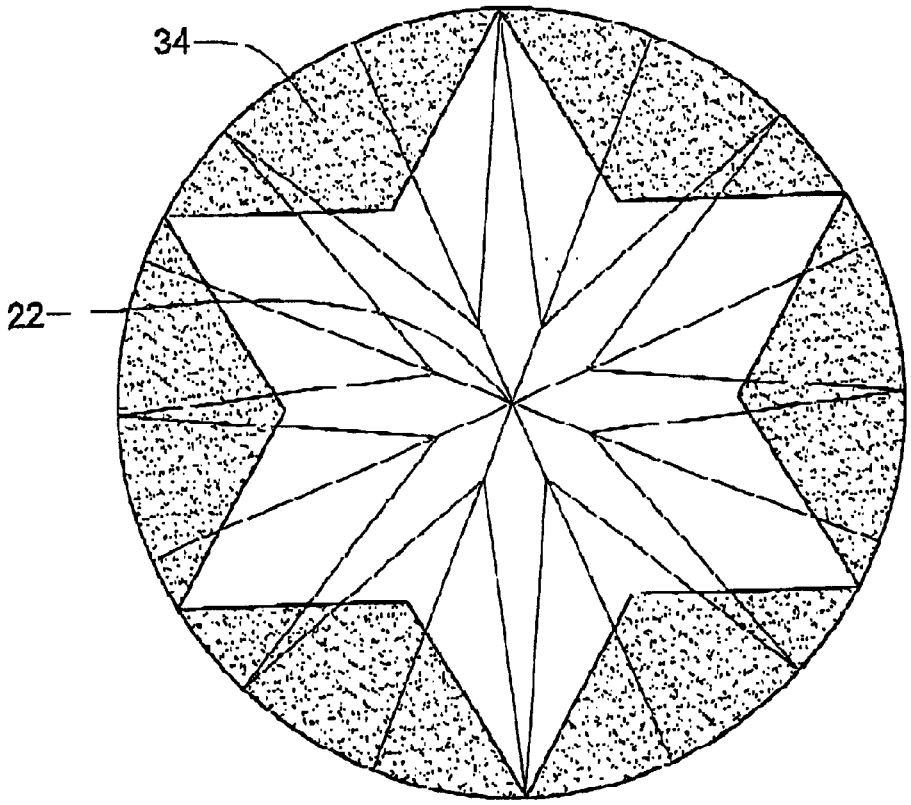

A diamond viewed from above is shown in FIGS. 2, 3, 4 and 7. The table 10, star 12, bezel 14 and upper girdle 16 facets are visible, as well as the upper edges of the girdle facets 8. The method of the invention comprises grooving six equally spaced, equally-sized triangularly-shaped 120° angled grooves in the girdle of the diamond. The first of the grooves is cut opposite a specified point in the crown. Preferably, the point is either a point 24 on the girdle opposite the center 26 of a bezel facet, or a point 28 on the girdle opposite the common rib line 30 of two adjoining upper girdle facets 16. FIG. 3 shows the cut out portions 32 of the diamond (shaded) when the initial grooving point is opposite the common rib line 30, and FIG. 4 shows the cut out portion 34 (shaded) when the initial grooving point 24 is opposite the center 26 of the bezel facet. FIGS. 5 and 6 show the respective cuts of FIGS. 3 and 4 viewed from below.

Figure 7:
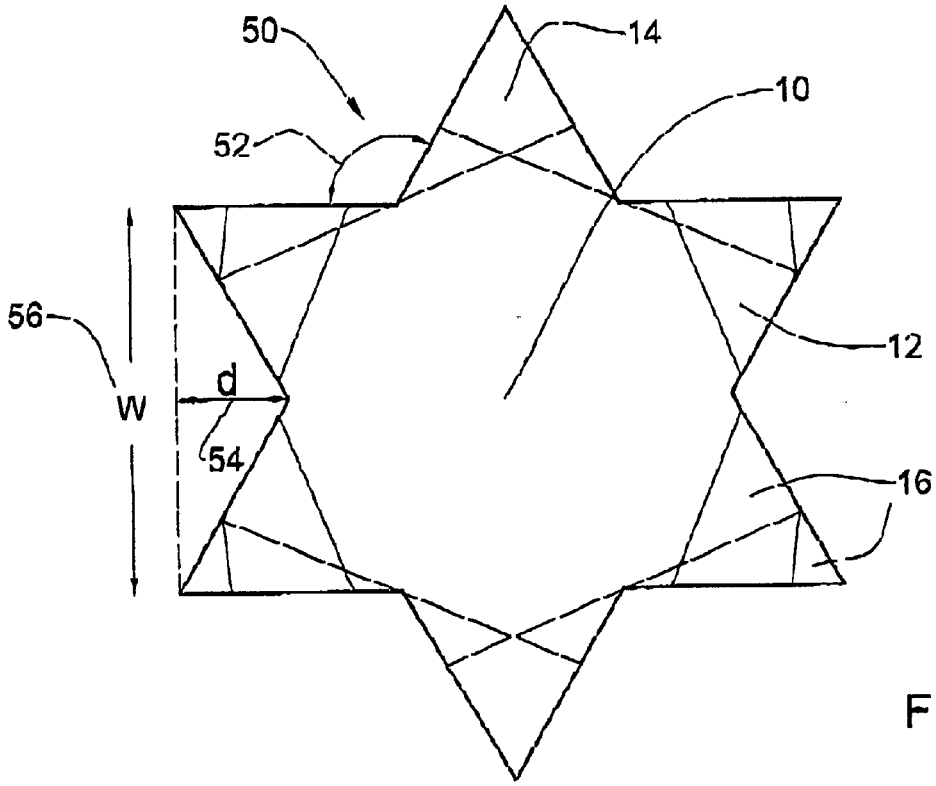
FIG. 7 is a top view of a diamond prepared according to one embodiment of the method of the invention.
Figure 8:
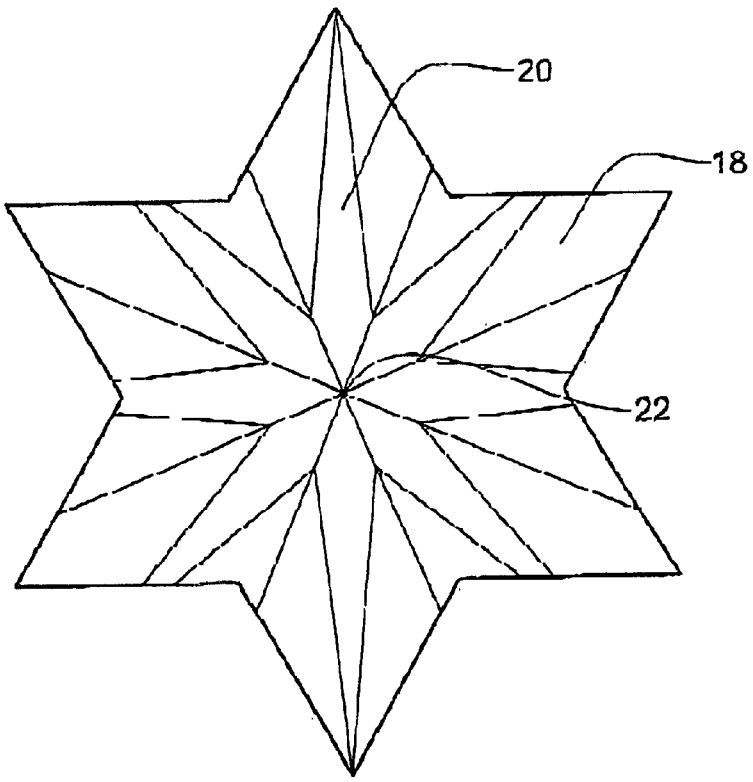
FIG. 8 is a bottom view of the diamond of FIG. 7.

FIG. 7 shows the diamond of FIG. 4 after the grooves have been removed. A groove 50 is triangularly shaped with an obtuse angle 52 of 120°. The depth 54 and the width 56 of the groove is substantially equivalent in each of the grooves so that they are equally sized, and they are spaced at substantially equal distances one from the other. FIG. 8 shows the diamond of FIG. 7 from below, in which can be seen the lower girdle 18 and pavilion 20 facets, and the culet 22.

The grooving is carried out by a grooving machine. The disc of the grooving machine may have a wedge-shaped, tapered edge which creates the 120° angle of the groove. Although initially the disc enters the diamond at the girdle, as the disc progresses into the diamond, the groove spreads to the crown and pavilion. Preferably, the girdle of the diamond is held perpendicularly to the plane of the disc.

Figure 9A:
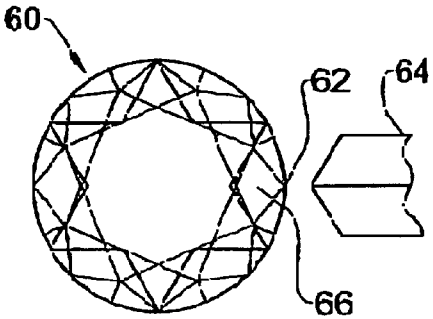
FIGS. 9*a*–9*g* illustrate various sequential steps in one embodiment of the method of the invention.

FIGS. 9*a*–9*g* illustrate one embodiment of the method of the invention. In FIG. 9*a*, a round diamond 60 is held in a dop, and a first position 62 of the diamond is positioned above the rotating disc 64. In this embodiment, the first position is opposite the center 66 of a bezel facet.

Figure 9B:
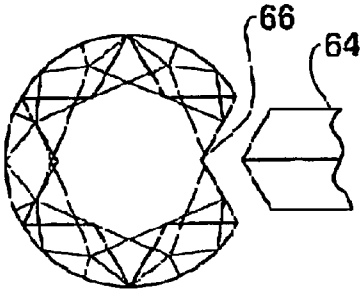
Figure 9C:
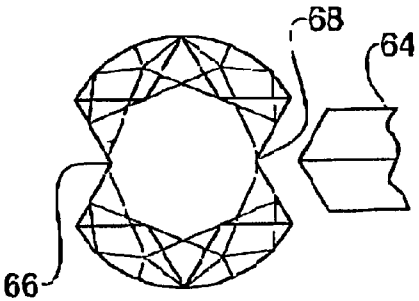
Figure 9D:
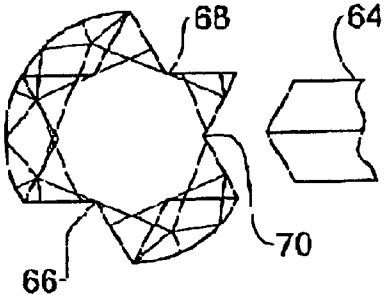
Figure 9E:
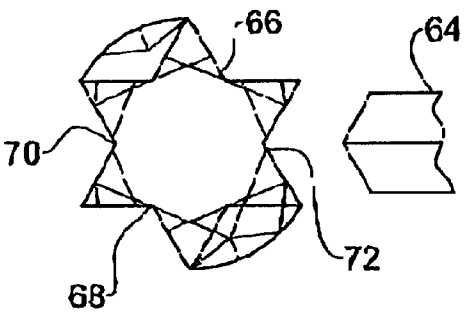
Figure 9F:
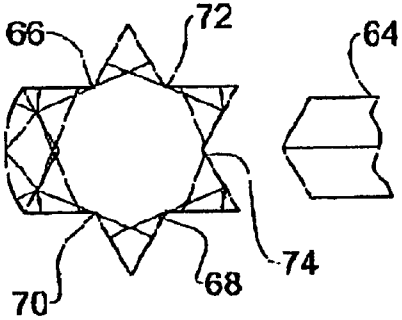
Figure 9G:
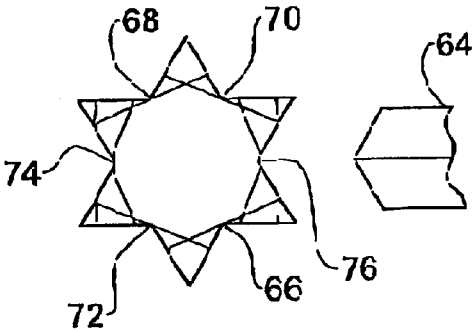

In FIG. 9*b*, a first 120° groove 66 is cut at the first position. The dop holding the diamond is then rotated (FIG. 9*c*) above the disc 64 to a second position 180° from the first position, and a second 120° groove 68 is cut in the diamond. The diamond is rotated (FIG. 9*d*) to a third position 60° from the second position, and a third 120° groove 70 is cut. The diamond is further rotated (FIG. 9*e*) to a fourth position 180° from the third position, and a fourth 120° groove 72 is cut. The diamond is then rotated (FIG. 9*f*) to a fifth position 60° from the fourth position, and a fifth 120° groove 74 is cut. Finally, the diamond is rotated (FIG. 9*g*) to a sixth position 180° from the fifth position, and a sixth 120° groove 76 is cut, resulting in the six-pointed Star of David shape.

What is claimed is:

1. A method for preparing a diamond having a six-pointed-star shaped girdle comprising:

(i) providing a round diamond; and (ii) grooving six equally spaced, equally-sized triangularly-shaped 120° angled grooves in the girdle of said round diamond by cutting said diamond to form said grooves.

2. A method according to claim 1 wherein an initial cut of the first of said grooves is cut at a position opposite a specified point in the crown, said specified point being either the center of a bezel facet or the common rib line of two adjoining upper girdle facets.

3. A method according to claim 1 wherein the grooving is carried out on a grooving machine.

4. A method according to claim 3 wherein said grooving machine comprises a 120° angled disc.

5. A method according to claim 1 comprising the following steps:

(i) providing a round diamond;

(ii) grooving a first 120° groove at a first position opposite a first specified point on the diamond;

(iii) grooving a second 120° groove at a position 180° from the first position;

(iv) grooving a third 120° groove at a position 60° from the second position;

(v) grooving a fourth 120° groove at a position 180° from the third position;

(vi) grooving a fifth 120° groove at a position 60° from the fourth position; and (vii) grooving a sixth 120° groove at a position 180° from the fifth position.

6. A six-pointed-star shaped diamond shaped by the method of claim 1.

7. A method according to claim 1 wherein said grooving of said triangularly shaped grooves comprises removing material from the diamond at said girdle whereby the six pointed star shape is formed with edges bounding the grooves cut from the girdle of the diamond.

8. A method according to claim 7 wherein the grooving of said triangularly shaped grooves at said girdle provides the six pointed star shape of the diamond when viewed from above or below the diamond.

9. A method according to claim 8 wherein said diamond has an outline at the girdle in which said grooves have been cut.

* * * * *